US006511016B2

(12) United States Patent
Bär et al.

(10) Patent No.: US 6,511,016 B2
(45) Date of Patent: Jan. 28, 2003

(54) SPIN-STABILIZED PROJECTILE WITH A BRAKING DEVICE

(75) Inventors: Klaus Bär, Lauf (DE); Jürgen Bohl, Eckental (DE); Karl Kautzsch, Schwanstetten (DE)

(73) Assignee: Diehl Munitionssysteme GmbH & Co. KG., Röthenbach (DE)

( * ) Notice: Subject to any disclaimer, the term of this patent is extended or adjusted under 35 U.S.C. 154(b) by 0 days.

(21) Appl. No.: 09/853,107

(22) Filed: May 10, 2001

(65) Prior Publication Data

US 2001/0039898 A1 Nov. 15, 2001

(30) Foreign Application Priority Data

May 12, 2000 (DE) ..... 100 23 345

(51) Int. Cl.[7] ..... F42B 10/00
(52) U.S. Cl. ..... 244/3.24; 244/213; 244/113
(58) Field of Search ..... 244/3.24, 3.25, 244/3.26, 3.27, 3.28, 3.21, 3.1, 49, 113, 213; 102/529

(56) References Cited

U.S. PATENT DOCUMENTS 3,047,259 A * 7/1962 Tatnall et al. ..... 244/138 R
5,762,291 A 6/1998 Hollis et al.

FOREIGN PATENT DOCUMENTS

| | | |
|---|---|---|
| DE | 28 56 859 A1 | 7/1980 |
| DE | 36 08 109 A1 | 9/1987 |
| DE | 198 45 611 A1 | 2/2000 |
| FR | 476.363 | 4/1914 |
| GB | 2 337 804 A | 12/1999 |

* cited by examiner

*Primary Examiner*—Galen L. Barefoot
(74) *Attorney, Agent, or Firm*—Scully, Scott, Murphy & Presser

(57) ABSTRACT

A spin-stabilised artillery projectile (11) can be easily subsequently fitted with an axially symmetrical aerodynamic braking device for reducing the ballistic trajectory if the tip (14) which is equipped with the fuse (13) and which is easily removable from the projectile body (12) is equipped at approximately half its height with flap-shaped sectors (24) which are pivotably mounted in such a way that they can be pivotably extended and which in their launch position fit snugly into the conical peripheral surface of the tip (14) and in the operative position are pivotably extended to form a radial ring which is closed or which has gaps.

7 Claims, 3 Drawing Sheets

SPIN-STABILIZED PROJECTILE WITH A BRAKING DEVICE

BACKGROUND OF THE INVENTION

1. Field of the Invention

The present invention relates to a spin-stabilized projectile having an aerodynamic braking device in a front region thereof, wherein the braking device can be radially extended along its trajectory from a launch condition into an axially symmetrical operative position.

2. Discussion of the Prior Art

The invention concerns a spin-stabilised projectile as set forth in the classifying portion of claim 1.

The projectile of the general kind set forth is known from WO 98/01719 A1. That involves arranging semicircular plates in the plane of separation between the projectile body and the projectile tip, wherein the semicircular plates, in mutually axially overlapping relationship, are displaced relative to each other azimuthally around the longitudinal axis of the projectile. They can be extended radially with respect to that longitudinal axis from their launch position within the contour of the projectile into the axially symmetrical operative position thereof in order then to shorten the ballistic trajectory as a result of the increase in aerodynamic resistance. Installation of the mechanism for displacing the plates between the two positions thereof and stable retention of the plates which are subjected to a heavy flexural loading in the extended position by virtue of the air flow thereagainst, precisely in the plane, which is critical in terms of structure and function, of the transition from the tip into the body of the projectile, does however involve serious construction risks, especially as that cross-sectional plane in itself is already fully occupied with the fuse components which here extend from the tip into the body of the projectile.

In comparison, it is known from DE 36 08 109 A1 to provide a braking device for a spin-stabilised projectile, in the central region thereof, in the form of a peripherally extending recess for forming stowage chambers for a cloth which, by virtue of the release of centrifugal weights which can be flung radially away, is opened out radially to form an annular braking sail around the peripheral surface of the projectile. The position thereof, in relation to the projectile body, admittedly basically affords greater structural freedom in regard to arranging the braking device when it is not yet extended into the operative position and the drive elements for moving it into the operative position, under the effect of centrifugal force; however, this arrangement requires total reconstruction of the projectile because of serious effects on the load-bearing structure and the payload space thereof. Another disadvantage is that there is no guarantee that the textile ring retains its shape, when the flow of air thereagainst is asymmetrical.

SUMMARY OF THE INVENTION

In consideration of those aspects, the technical object of the present invention is that of equipping a projectile of the general kind set forth, with an easily activatable, operationally reliable, aerodynamic braking device which is uncontrolled (and which therefore has an on-off or two-position characteristic) but which nonetheless is highly effective.

In accordance with the invention, as set forth in the characterising portion of the main claim, that object is essentially attained in that provided as the aerodynamic braking device approximately in the central region of the projectile tip is a flap system which is in the form of sectors of a ring and which is pivotable out of the launch position in opposite relationship to the afflux flow of air thereagainst into a geometrically defined operative position and which is coupled there in a peripherally extending recess to the wall of the fuse casing. As the fuse is disposed in the tip of the large-calibre munition which is of interest here, for cannon artillery, the complete tip is designed for disassembly, that is to say, it is mounted on the body of the projectile in such a way as to be readily interchangeable. In that way, the conventional munition which is in use can also still be subsequently equipped with this braking device for influencing the projectile trajectory, insofar as the conventional projectile tip is simply replaced by another tip with the braking elements.

Admittedly, it is known in this respect from DE 198 45 611 A1 for trajectory control in the case of non-spin and in the case of fin-stabilised projectiles to be effected by correction elements being extended in axially asymmetrical relationship to a greater or lesser degree out of a separate correction unit, from the missile body or also from the fuse; in that arrangement however, a quite considerable installation space is required for the control, which is always continuous in that case, in respect of the correction elements and the adjusting force acting thereon, and such installation space is only available with difficulty, even in the event of major redesign in fuse systems which are in use.

In accordance with the present invention in contrast the centrifugal force on the spin-stabilised projectile causes the flap-shaped sectors of the braking device to pivot out in an unbraked swinging movement, into a star-shaped, substantially radially oriented operative position which is afforded by virtue of the force equilibrium in respect of the dynamic pressure forces and centrifugal forces acting on the braking elements. That means that there is no need to provide for structural elements operative for actively extending the braking device, in the interior of the projectile tip, so that this braking system can be mounted to the projectile relatively far forwardly around the tapered region of the tip where the aerodynamic braking effect is at the greatest and therefore the braking flaps can be relatively short. The position as far as possible in front of the plane of separation in relation to the projectile body is also desirable because there the interior of the tip is practically not required for fuse functions and because that region is also structurally insignificant in terms of the flexural stiffness of the projectile overall, that is to say, it certainly tolerates a weakening of the fuse casing due to radial openings for mounting the pivotal shafts for the braking flaps therein. In this case, the individual flap-shaped braking sectors are not pivoted outwardly until they come to bear against an abutment which is fixed with respect to the casing, because that would give rise there to critical stability problems, especially in relation to an afflux flow of air which possibly acts in the extension direction. In the case of munition involving a slight amount of spin, the outward pivotal movement of the braking elements can be promoted by leg springs which are disposed therebehind and which are tensioned between the braking elements and the casing of the projectile tip. Desirably, in any event, the arrangement involves a simple latching action to prevent a return movement of the flap sectors of the braking device, which swing freely in their operative position, so that, once the braking device has reached its geometrically defined operative position, the braking device reliably remains in that operative position immediately and even under fluctuating afflux conditions, in the interests of a stable braking characteristic.

In the launch position of being pivoted into the casing, the flap-shaped braking elements scarcely project radially. Therefore they may not be so wide that for example at their pivotal mounting, they project laterally beyond the peripheral surface of the fuse tip. Therefore, comparatively narrow flaps are pivotably mounted in mutually displaced relationship in the peripheral direction, on pin-like pivotal shafts which are mounted asymmetrically. Spring supports can be arranged under each two mutually adjacent flaps in order to promote uniformly occurring extension of all flaps, over the entire periphery of the tip, by virtue of the flaps mutually assisting each other.

The flap-shaped braking elements which are in the form of sectors of an annular disc and which in their launch position are retracted against the fuse casing parallel to the peripheral surface of the cap cannot therefore overlap each other to such a degree in the peripheral direction of the fuse casing that, in the radially extended position, in a front view, they define a closed, radially wide ring around the tip, and for that reason in the extended position the arrangement does not provide an uninterrupted annular disc but a widely spread spoke-like structure. The aerodynamic braking action thereof however is only slightly reduced in comparison with a closed annular disc because eddy and turbulence losses at the transitions from the closed sectors to the gaps therebetween result in additional braking effects. The braking action however can be still further increased if the intermediate spaces between the sectors of the annular disc are bridged over by flexible elements, for example by textile portions, which are extended between the sectors upon extension of the flaps. In that respect, a simpler pivotal mounting, with a braking device structure which is geometrically and mechanically stable, is afforded if the flap-shaped sectors of the annular disc are narrowed to form thin spokes which impart geometrical stability, even under fluctuating aerodynamic influences, to a textile structure which is extended in the form of an annular disc in the manner of an umbrella, as a result of a radial bracing action. The textile ring which is braced by the spokes can then be still further enlarged by an edge portion which extends therearound in an unbraced condition, in order to optimise the braking engagement surface area for the afflux flow.

If on the other hand the substantially textile uninterrupted structure of the braking device is to be replaced by an annular surface which is mechanically more stable as it is metallically closed in the afflux direction, as in fact cannot be achieved without gaps due to the width of the flap-shaped sectors alone, then those braking elements can be provided at both sides, at their radially extending longitudinal edges of the sectors in question, with triangular spring plates which alternately overlap each other in the inwardly folded condition of the sectors, being elastically adapted to the peripheral surface curvature of the projectile tip, and in the stretched extended condition just cover over in pairs the openings, which in themselves are free, between the flaps.

BRIEF DESCRIPTION OF THE DRAWINGS

In regard to additional advantages, alternatives and developments, besides the appendant claims attention is also directed to the description hereinafter of a preferred embodiment diagrammatically shown in the drawing, being restricted to what is functionally essential in highly abstracted form but approximately true to scale, while in regard to use of a spin-stabilised projectile with such an aerodynamic braking device, for the avoidance of repetition reference is directed in respect of its full content to our prior German patent application entitled 'Method for the target-related correction of a ballistic trajectory', filing No 199 57 363.8 of Nov. 29, 1999. In the accompanying drawing:

DETAILED DESCRIPTION OF PREFERRED EMBODIMENTS

Figure 1:
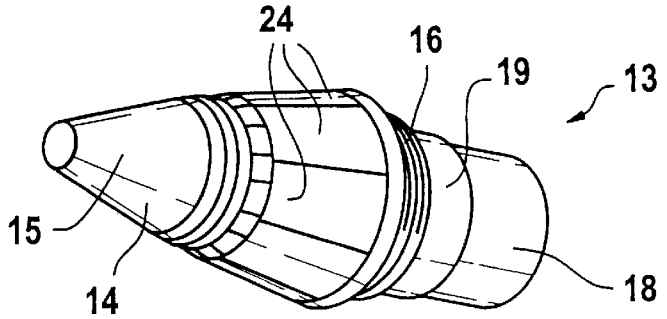
FIG. 1 is a view of an artillery fuse with inactive braking device.

A spin-stabilised artillery projectile 11 substantially comprises an elongate hollow body 12 into which a removable fuse 13 frontally engages. The fuse 13 is thus part of the tip 14 of the projectile 11, the contour of the tip being substantially determined by its ballistic cap 15.

The fuse 13 is releasably connected to the body 12 by way of a coaxial screw means 16. It then projects through the plane of separation 17 between the tip 14 and the body 12 of the projectile 11, at least with a firing amplifier or transfer charge 18 together with a safety device 19, into the front region of the body 12. Disposed in front thereof, approximately in the separation plane 17, is a navigational unit 20 based for example on satellite navigation, behind a battery 21 in the base of the projectile tip 14. An electronic firing system 23 is arranged approximately in the axial central plane between the battery 21 and the electronic evaluation unit 22 in the front region of the fuse 13.

As elements of the braking device, flap-shaped sectors 24 of an annular disc are mounted in the peripheral region thereof, such that they can be pivoted out forwardly—that is to say in opposite relationship to the afflux flow—under the effect of centrifugal force, without involving an abutment. For that purpose, a pin 25 which is oriented tangentially in the peripheral region is associated as a short mounting and pivotal shaft, with each of the flap-shaped sectors 24. The pins 25 are disposed in radial recesses 26 which are formed in the peripheral direction in the fuse casing 27, approximately in the central transverse plane of the tip 14. The beginning and the end, that is to say the mounting locations, of the sequence of pins 25 which extend around the projectile in a cross-sectional plane, are not however disposed on a circle which is concentric with respect to the longitudinal axis 28 of the projectile, but they are radially asymmetrical, that is to say they are radially displaced with one end inwardly of that circle and with the other end outwardly, so that the pins 25 which are adjacent at both sides in the peripheral direction are mounted radially in front of and behind same respectively. That deviation out of the direction of the secants in the above-mentioned notional circle, and thus the fact that the pins 25 are oriented asymmetrically with respect to the axis 28, mean that it is possible for the mountings thereof at both sides to be identical in nature for all the pins 25, thereby to promote a symmetrical extension movement in respect of the individual sectors 24 which are mutually adjacent in the peripheral direction.

Figure 2:
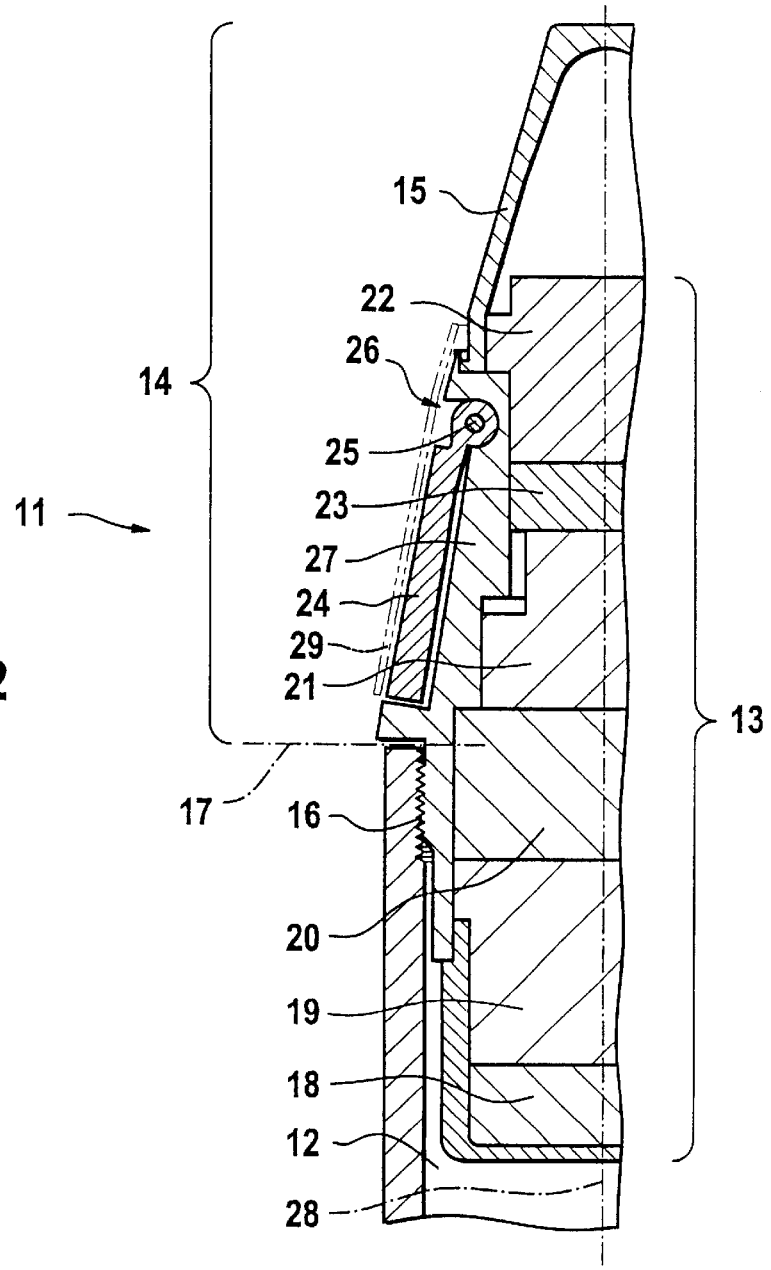
FIG. 2 shows the fuse of FIG. 1 in a broken-away view in axial longitudinal section.

The relatively narrow sectors 24 are of a curved profile about their longitudinal axes in such a way that, in the retracted or launch condition, as shown in FIGS. 1 and 2, they are adapted as well as possible to the contours on the one hand on the inside of the casing 27 and on the other hand on the outside of the rearward extension of the ballistic cap 15 which is stepped here. In that launch condition a holding sleeve 29 (shown in broken line in FIG. 2) can be fitted over the retracted braking flaps (ring sectors 24) in order to define the peripheral surface contour of the shortened cap 15, in the rearward extension thereof, that is to say, to ensure the aerodynamically smooth geometry and not to alter it in relation to the peripheral surface of the conventional projectile tip. For the purposes of pivotally extending the sectors 24 into the operative position of the braking device, that sleeve 29 is pyrotechnically blown off, for example being split open along desired-rupture locations. When using a sleeve 29, because of the centrifugal forces acting thereon and in particular because of the afflux flow, that can be effected more easily than blowing off an aerodynamic cap which is hermetically closed in the direction of flight but which could also be fitted over the inwardly folded sectors 24, in accordance with the present invention.

By removal of the holding sleeve 29 (or by axial displacement of a locking ring—not shown) the sectors 24 are released to pivotally extend about the pins 25, under the effect of the centrifugal force, and that can be still further promoted by means of integral or fitted leg bending springs (not shown), being supported with respect to the casing 27. In order to promote synchronous outward pivotal movement of the peripherally mutually adjacent sectors 24 which are now released, in spite of a somewhat asymmetrical afflux flow, it is also possible, instead of bulky leaf springs, to provide at the pivot pins 25 spring supports which simply project radially by a short distance and which each extend over at least two mutually adjacent sectors 24 (not shown in the drawing).

Figure 3:
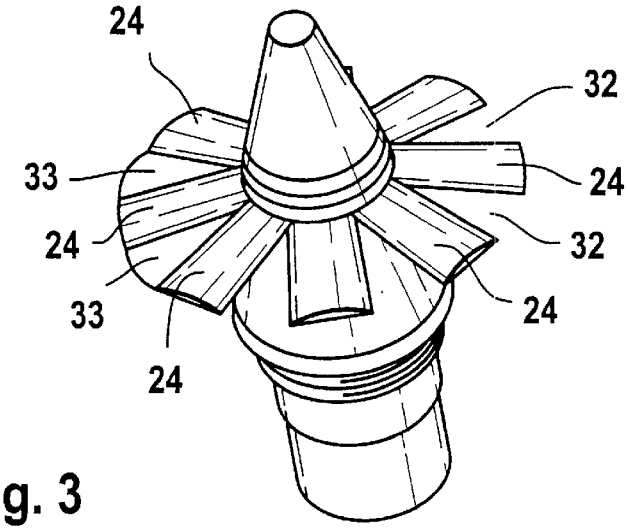
FIG. 3 shows a view of the fuse of FIG. 1 with the braking device activated.
Figure 4:
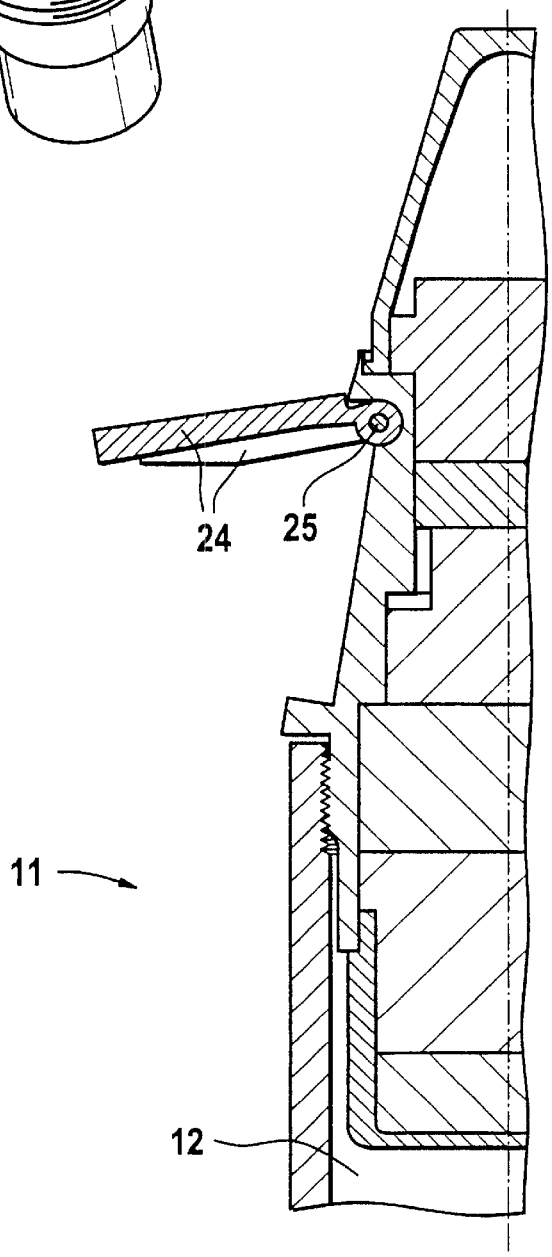
FIG. 4 shows the fuse of FIG. 3 in a broken-away view in axial longitudinal section.

For the reasons already referred to in the opening part of this specification, it is inevitable that the braking device comprising the extended, relatively narrow individual sectors 24 of the annular disc, forms gaps in a spoke-like configuration. In order to close the openings 32 formed by those gaps (FIG. 3) in order to enhance the braking action, it is possible to provide between each two mutually adjacent sectors 24 a flexible bridging portion 33 which is stretched out in the course of extension of the sectors 24, as shown at the left in FIG. 3. That bridging portion 33 between the sectors forming the annular braking disc can comprise for example textile fabric which, in the inwardly folded condition of the sectors 24, is folded in radially under them. The sectors 24 can then even be thinned down to the form of narrow radial spokes, the suspension of which on short pins 25 gives rise to fewer structural problems than the flap suspension of the wider sectors 24, and which in the extended condition afford a stiffening effect, which is structurally defined in an umbrella-like manner, for the braking device which is then generally of a textile nature in the form of an annular disc.

Figure 5:
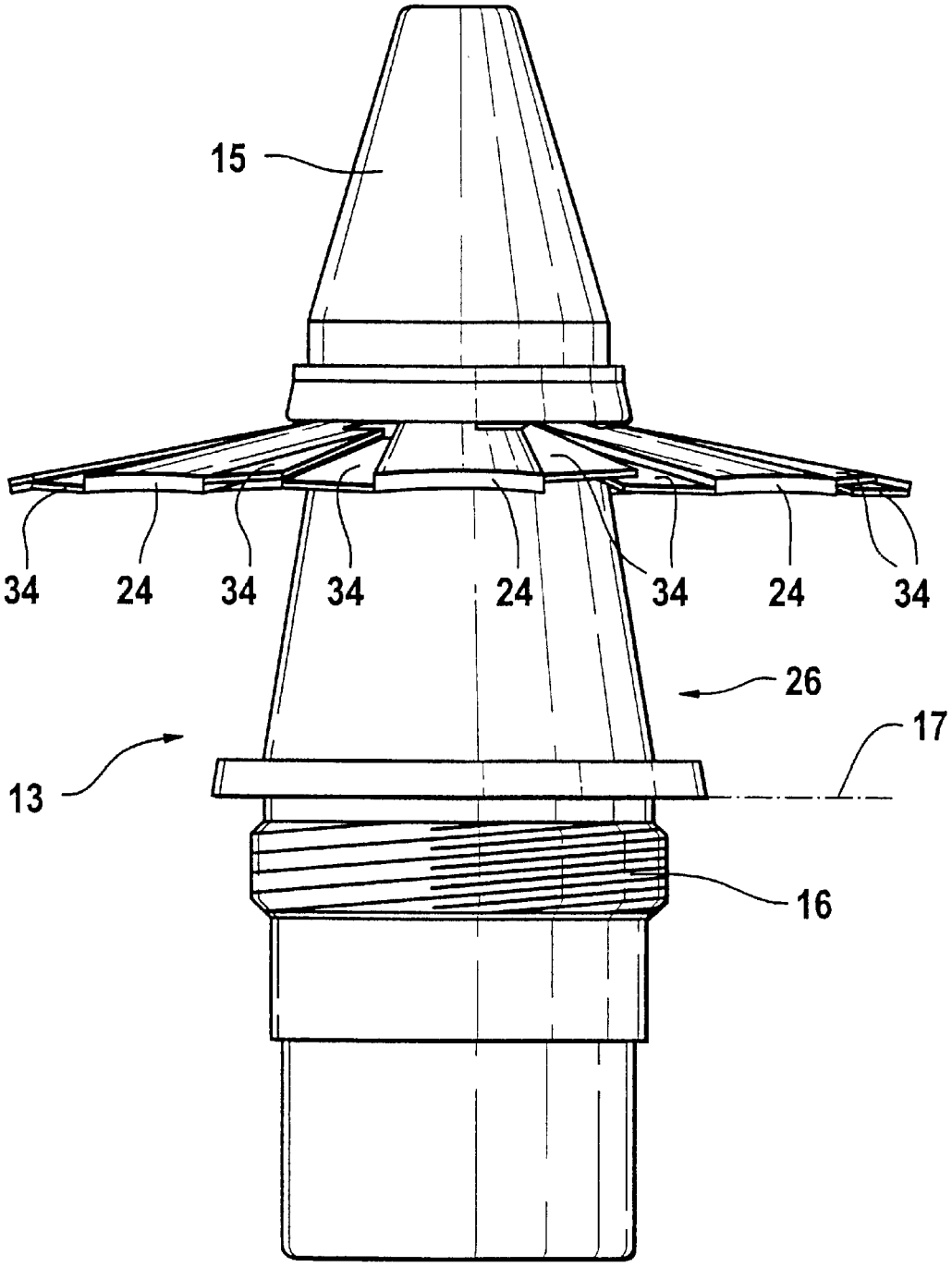
FIG. 5 shows a fuse whose radially extended braking device has a metallic annular disc structure which is closed in the afflux direction.

If on the other hand the wish is for the braking device to be in the form of a metal annular disc which has as few gaps as possible in the afflux direction, then the individual sectors 24, at their radially extending longitudinal edges, are fitted with spring plates 34 which are of a triangular edge contour and which are welded or riveted to the sectors and which preferably in the curved launch condition of the braking device, under the sleeve 29, come to lie alternately over and under each other. That is promoted if the spring plates 34 of a sector 24 are connected thereto in mutually displaced planes, as can be clearly seen from FIG. 5. That arrangement also promotes rapidly progressively peripheral outward pivotal movement of the sectors 24 into their functional positions in which the mutually adjacent spring plates 34 which are now relieved of load in planes still just overlap each other to form the closed ring.

A spin-stabilised artillery projectile 11 can therefore easily be subsequently fitted with an axially symmetrical aerodynamic braking device for the purposes of shortening the ballistic trajectory if the tip 14 which is equipped with the fuse and which can be easily removed from the projectile body 12 is fitted at approximately half its height with sectors 24 which are pivotally mounted thereto in such a way that they can be extended with a pivotal movement under the effect of centrifugal force and which in their launch position fit snugly into the conical shape of the peripheral surface and which in the operative position are pivoted out to form a radial ring which is extended in a closed configuration or a configuration with gaps therein. The one-off time-discrete use with a fixed setting value due to the deliberate increase in aerodynamic resistance—with a variation in the braking action on the trajectory configuration by way of adaptation of the moment in time at which the braking device is extended—thus affords a high-explosive projectile or shell the option of a reduction in its trajectory, while moreover for a bomblette with adaptation of the ejection time it permits a further option in terms of intervening in the function involved.

What is claimed is:

1. A spin-stabilized projectile (11) having an aerodynamic braking device in a front region of the projectile, said braking device along the trajectory of said projectile being radially extendable from a launch position into an axially symmetrical operative position, a tip (14) of the projectile being provided at approximately a central transverse cross-sectional plane thereof with mounting locations for flap-shaped ring sectors (24) of an annular disc, said disc being pivotable from the launch position in which it is retracted in the peripheral surface region of the tip (14) outwardly from the launch position thereof in opposition to an afflux flow of oncoming air acting thereagainst into an operative geometrically defined extended position approximately transversely with respect to a longitudinal axis (28) of the projectile; said flap-shaped sectors (24) being pivoted radially outwardly into the operative position about pins (25) which are supported in a fuze casing (27) of the projectile tip in transversely oriented relationship with the longitudinal projectile axis (28), said pins (25) each being mounted in a position for being deflected asymmetrically out of a secant orientation, whereby a first end of each said pin (25) is at a greater distance from the longitudinal projectile axis (28) than an-opposite end of the pin behind which a peripherally adjoining pin (25) engages, with said opposite end being at the greater spacing radially with respect to the longitudinal axis (28) of the projectile.

2. A projectile according to claim 1, wherein the sectors (24) are suspended around the pins (25) through the interposition of leg-shaped bending springs which are supported radially with respect to the sectors (24) against the fuze casing (27).

3. A projectile according to claim 1, wherein the sectors (24) have widths which overlap each other in the launch position so as to in the operative position thereof collectively form a closed ring which has gaps (32) formed by openings therein extending substantially transversely with respect to the longitudinal axis (28) of the projectile.

4. A projectile according to claim 3, wherein the gaps (32) are spanned across by flexible bridging means (33) stretching between mutually peripherally adjacent said sectors (24).

5. A projectile according to claim 1, wherein the sectors (24) are constituted of narrow spokes.

6. A projectile according to claim 3, wherein the sectors (24) are each laterally fitted with triangular spring plates (34) which overlap in the launch condition and which in the outwardly pivoted operative position close the gaps (32) between the sectors (24) to form said closed ring.

7. A projectile according to claim 6, wherein the spring plates (34) are each fixed to respectively one said sector (24) on both sides thereof in mutually displaced relationship in the axial direction of the projectile.

* * * * *